US009271590B2

(12) United States Patent
Ecseri et al.

(10) Patent No.: US 9,271,590 B2
(45) Date of Patent: Mar. 1, 2016

(54) DRINKING STRAW AND METHOD AND DEVICE FOR MANUFACTURING A DRINKING STRAW

(71) Applicant: Silman Invest & Trade Ltd., Victoria, Mahe (SC)

(72) Inventors: Ferenc Ecseri, Cegled (HU); Monika Ecseri, Budapest (HU)

(73) Assignee: Silman Invest & Trade Ltd., Victoria, Mahe (SC)

( * ) Notice: Subject to any disclaimer, the term of this patent is extended or adjusted under 35 U.S.C. 154(b) by 245 days.

(21) Appl. No.: 13/944,511

(22) Filed: Jul. 17, 2013

(65) Prior Publication Data

US 2014/0017360 A1 Jan. 16, 2014

Related U.S. Application Data

(63) Continuation-in-part of application No. PCT/HU2012/000081, filed on Aug. 30, 2012.

(30) Foreign Application Priority Data

| | | |
|---|---|---|
| Sep. 1, 2011 | (HU) | 11 00477 |
| Aug. 29, 2012 | (HU) | 12 00495 |
| Nov. 16, 2012 | (HU) | 12 00663 |

(51) Int. Cl.
*A47G 21/18* (2006.01)

(52) U.S. Cl.
CPC ..... *A47G 21/183* (2013.01)

(58) Field of Classification Search
CPC ... A47G 21/18; A47G 21/183; A47G 21/188; A47G 21/186; A47G 21/189; A47G 19/22; A47G 19/2222; B65D 77/28; B65D 77/283; B65D 77/286; B65D 2517/0049; B65D 2517/005; A23C 9/156; A23L 2/56; A61J 15/00; B65B 29/02
USPC ..... 426/138, 85, 89, 91, 289, 96, 103, 106; 220/705, 706, 707, 708, 709, 710; 239/33, 24, 16; 264/209.1; 137/268
See application file for complete search history.

(56) References Cited

U.S. PATENT DOCUMENTS

| | | | | |
|---|---|---|---|---|
| 2,094,268 | A * | 9/1937 | Friedman | 239/33 |
| 2008/0075809 | A1 * | 3/2008 | Anderson | 426/85 |

OTHER PUBLICATIONS

Rucker, Laura. "Review: Got Milk? Cocoa—Magic Milk Straws." Oct. 6, 2010. <http://www.gotchocolate.com/2010/10/review-got-milk-cocoa-magic-milk-straws/>. Accessed May 8, 2015.*

* cited by examiner

*Primary Examiner* — Rena L Dye
*Assistant Examiner* — Ericson M Lachica
(74) *Attorney, Agent, or Firm* — Olson & Cepuritis, Ltd.

(57) ABSTRACT

A drinking straw comprises a thermoplastic tube and an active ingredient in the tube, releasable in a liquid drawn through the tube. The active ingredient is held in place between branched portions of the straw defined by neighbouring recesses formed in the tube and an inner seam connecting the neighbouring recesses. The branched portions are spaced from the ends of the straw. A device and method for making the drinking straw are disclosed as well.

7 Claims, 4 Drawing Sheets

DRINKING STRAW AND METHOD AND DEVICE FOR MANUFACTURING A DRINKING STRAW

CROSS-REFERENCE TO RELATED APPLICATIONS

This application is a continuation-in-part of International Application No. PCT/HU2012/000081, filed on Aug. 30, 2012, and claims priority of Hungarian Patent Application No. P 12 00663, filed on Nov. 16, 2012, Hungarian Patent Application No. P 12 00495 filed on Aug. 29, 2012, and Hungarian Patent Application No. P 11 00477, filed on Sep. 1, 2011, each of which is incorporated herein by reference in its entirety.

FIELD OF THE INVENTION

The invention relates to a drinking straw for progressively adding active ingredients to liquid passing through the drinking straw.

The invention further relates to a method and a device for manufacturing such a drinking straw.

BACKGROUND OF THE INVENTION

Various types of drinking straws are known for flavouring or changing the flavour of a liquid passing through the drinking straw. Such drinking straws can impart different flavours (e.g. cocoa, fruit, etc.) to a liquid for example milk.

There are solutions in which the flavouring agent is applied on a portion of the drinking straw and dissolves when this portion is immersed in the liquid. Patent application U.S. Pat. No. 3,615,595 describes such flavouring drinking straw. In another embodiment according to U.S. Pat. No. 3,615,595 the flavouring agent is applied on the inner wall of the drinking straw. A disadvantage of this solution is that dissolution of the flavouring agent thereby the flavouring effect is unsatisfactory.

Another common way of disposing the flavouring or other active agents within the drinking straw is by providing granules that contain the flavouring or other active agents that are progressively imparted to a liquid drawn through the drinking straw. A problem associated with this type of flavouring is that the granules have to be retained within the straw. Various devices have been suggested in the prior art for overcoming this problem.

Patent applications U.S. Pat. No. 6,482,451 B1 and U.S. Pat. No. 8,334,003 propose the use of filters the apertures of which are smaller than the cross-section of the granules whereby the liquid can be drawn through the apertures but the granules are retained. The proposed filters are in the form of end caps, whereby the manufacturing costs are increased: the filters need to be manufactured as separate elements and need to be affixed to the drinking straw in a separate manufacturing step. In practice the affixing is carried out by welding the wall of the straw and the inserted end cap from the outside whereby an external seam is formed on the outside of the wall of the straw. The sharp edges around the external seam have to be removed, which requires a further manufacturing step and may still leave unsmooth surface regions.

The problem of having to provide a separate filtering cap is partly overcome in the prior art. Patent application US 2008/0197141 A1 discloses a filled drinking straw both end parts of which are pressed together in a direction perpendicular to the longitudinal axis of the drinking straw thereby creating a narrow passage in order to prevent the undissolved flavouring granules from exiting the straw. By pressing the end parts the plastic body of the tube may also be pressed in a certain extent. To avoid this braces are placed in the tube near the pressed portion. However, if the tube is pressed transversally, large sized fillings can not be fixed in given portions of the tube since they may crack. Furthermore, flow of liquid is restricted because the cross-section is narrowed down to a single harrow passage, which is easily blocked by fillings. Another disadvantage is that sharp edges are formed on the outer surface of the pressed portion which might be inconvenient for the user and in particular for young children who will generally attempt to take more than the mouth piece into their mouth.

Patent application US 2008/0075809 proposes a drinking straw wherein the dissolvable granules are retained by crimping the straw body near the two ends which creates closures that slightly open when liquid is being drawn through the straw thereby allowing the liquid and the dissolved substances to pass through a narrow passage. This solution has for disadvantage that the opening of the crimps cannot be controlled whereby a smaller or larger passage might be created depending on the sucking force applied by the user. A further disadvantage associated with this type of retaining means is that the active ingredient concentration of the liquid drawn through the single narrow passage might vary substantially in time, since it is determined by the local concentration at the opening of the passage. Also such a single passage may be easily blocked by a filler such as a granule.

A further disadvantage of both of the above mentioned solutions is that the wall of the drinking straw is heated from the outside when deforming the straw. During this operation the straw can only be exposed to a heat that does not cause melting, since that would destroy the straw. Furthermore, the straw is generally made of a shape-memory plastic, generally polypropylene, therefore the crimped or otherwise deformed straw may reopen later on.

US 2012/0228400 A1 discloses integral filters formed from the sidewall of the drinking straw adjacent the ends thereof. According to a preferred embodiment the integral filter is formed by clamping and bonding the opposing sides of the tube ends such that an external seam is created, and by perforating the bonded side walls in order to allow liquid communication therethrough but retain the flavouring granules. The disadvantage of such an integral filter is that in spite of trimming any sharp corners along the seam uneven edges may remain that could be inconvenient for a user or even hurt or cut the mouth of the user, especially young children. The edges of the apertures may also be sharp or have inconvenient irregularities presenting the same disadvantage. According to other embodiments the integral filter is formed by cutting and folding or by deforming the tube end such as to cover most of the straw opening and by leaving only a narrow central aperture. The cut or deformed tube ends as well as the edges of the central aperture have the same disadvantage as explained before, furthermore, the deformed portions may reopen during use.

It is an object of the present invention to overcome the problems associated with the prior art. In particular, it is an object of the invention to provide a drinking straw filled with fillers such as flavouring granules that does not contain filters or other inserts and wherein retention of the fillers is achieved by deforming a portion of the drinking straw. A further object is to provide a permanent and durable deformation of the straw in order to retain the fillers. It is a further object to create a user friendly deformed portion that cannot cut or otherwise hurt the mouth of the user. It is a further object not to hinder the liquid flow through the straw. A further object is to simplify manufacturing of the straw and to reduce the costs thereof by eliminating the need of filters, since such filters are manufactured as separate pieces that need to be fixed inside the straw in a separate manufacturing step.

The inventors have recognised that the above objects can be achieved if the straw is deformed spaced apart from its ends such that the inside of the straw is heated at given points (locations) for a short period in order to melt the inner surface of the wall and then the melted points are pressed together. In this case an internal seam is formed at the melted and pressed points. Complete closure of the cross-section of the straw is preferably ensured by applying spacers that create parallel passages between the pressed portions whereby the deformed portion of the straw is in the form of a branched portion. The plurality of passages ensure adequate liquid flow through the deformed branched portion and are less easily blocked than a single passage. This method also allows for fixing various filling elements along the straw, which can be fixed in the same manner. It should be appreciated that when fixing such a filling element the straw is pressed to such an extent only so as to securely hold the filling element the desired location.

SUMMARY OF THE INVENTION

In view of the above recognition the objects of the invention are achieved by a drinking straw which is a thermoplastic tube having a first end and a second end comprising:

- a first tubular end portion adjacent the first end and defining a single passage;
- a first branched portion spaced from the first end and defining at least two parallel passages in fluid communication with the single passage of the first tubular end portion;
- a second tubular end portion adjacent the second end and defining a single passage;
- a second branched portion spaced apart from the second end and defining at least two parallel passages being in fluid communication with the single passage of the second tubular end portion; and
- a hollow elongate middle portion providing fluid communication between the parallel passages of the first branched portion and the parallel passages of the second branched portion; and
- a filler in the middle portion, said filler containing an active ingredient releasable in liquid drawn through the straw;

the parallel passages of the first and second branched portions being defined by neighbouring recesses formed in the tube and an inner seam connecting the neighbouring recesses; and the filler and the parallel passages being sized to prevent the filler from passing through the parallel passages of the first and second branched portions.

The invention further relates to a method for manufacturing a drinking straw filled with a filler containing an active ingredient releasable in liquid drawn through the drinking straw, the method comprising the steps of:

- providing a straw which is a thermoplastic tube having a cylindrical wall, a first end and a second end;
- forming the wall of the straw into a first branched portion spaced from the first end of the straw by heating at least two given regions of an inner side of the wall, pressing the heated wall regions against each other such as to form recesses therein and such as to create an inner seam between the inner points of the recesses contacting each other thereby defining at least two parallel passages within the first branched portion;
- providing a filler containing an active ingredient and being sized to prevent the filler from passing through the parallel passages;
- filling the filler into the straw from the second end;
- forming the wall of the straw into a second branched portion spaced from the second end of the straw by heating at least two given regions of the inner side of the wall, pressing the heated wall regions against each other such as to form recesses therein and such as to create an inner seam between the inner points of the recesses contacting each other thereby defining at least two parallel passages within the second branched portion.

The invention further relates to a device for forming a thermoplastic wall of a straw into a branched portion defining at least two parallel passages therein, comprising

- a nozzle dimensioned for insertion into the straw and having at least two openings for blowing hot air at an inner side of the wall of the straw and thereby heating and plasticizing regions thereof;
- a pressing tool having pressing rods that can be arranged around the external side of the wall for pressing the heated regions of the wall such as to form recesses in the wall and such as to press the inner points of the recesses together in order to create an inner seam connecting the recesses.

Further advantageous embodiments of the invention are defined in the attached dependent claims.

Further details of the invention will be apparent from the accompanying figures and exemplary embodiments.

DETAILED DESCRIPTION OF PREFERRED EMBODIMENTS

Figure 1:
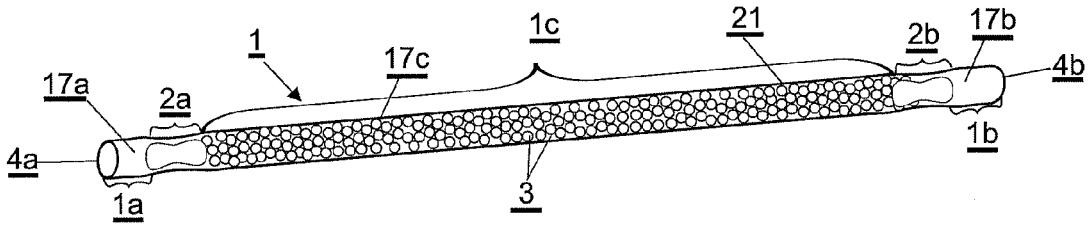
FIG. 1 is a schematic perspective view of a first embodiment of a drinking straw according to the invention.

FIG. 1 schematically illustrates a first preferred embodiment of a drinking straw 1 in accordance with the present invention. According to the illustrated embodiment the straw 1 comprises a first tubular end portion 1*a*, a second tubular end portion 1*b*, a hollow elongate middle portion 1*c*, a first branched portion 2*a* connecting the first tubular end portion 1*a* with the middle portion 1*c* and a second branched portion 2*b* connecting the second tubular end portion 1*b* with the middle portion 1*c*. The straw 1 and its portions 1*a*, 1*b*, 1*c*, 2*a*, 2*b* are defined by a plastic wall 21 having a first end 4*a* and a second end 4*b*. The first tubular end portion 1*a* is adjacent the first end 4*a* of the straw 1 while the second tubular end portion 1*b* is adjacent the second end 4*b* of the straw 1.

The first and second branched portions 2*a*, 2*b* each define at least two but preferably three to five parallel passages 17 (see FIG. 5) that are in fluid communication with a single passage 17*a*, 17*b* of the first and second tubular end portion 1*a*, 1*b* respectively. The parallel passages 17 of the first and second branched portions 2*a*, 2*b* are defined by neighbouring recesses 22 formed in the wall 21 of the straw 1 and an inner seam 23 connecting inner points of the neighbouring recesses 22.

In the present embodiment the elongate middle portion 1*c* also comprises a single passage 17*c* providing fluid communication between the parallel passages 17 of the first and second branched portions 2*a*, 2*b*. The passage 17*c* of the middle portion 1*c* is partly or fully filled with a filler 3 preferably in the form of granules and containing solvable active ingredients that progressively dissolve into a liquid drawn through the straw 1. Such active ingredients may be flavouring substances, edible colorants, vitamins, minerals, food additives and the like.

The term "granule" is understood to include all kinds of small grains, particles, granulate materials, pellets, nonpareils, dragees etc. used in the food industry. The granules may have a homogeneous structure wherein the one or more active ingredients are homogeneously distributed in a carrying material.

According to another embodiment the granules may comprise a core and one or more coatings provided thereon. For example the core may be a sugar seed and a coating comprising one or more active ingredients may be formed thereon by various technologies. Some of the granules may contain an outer coating that serves as a time delay surface coating, whereby release of the active ingredient contained in an inner coating or in the core is delayed as long as the delayed release surface coating is not dissolved. The granules may contain such delayed release surface coatings in different thickness, whereby the granules start to release the active ingredients after different time spent in the liquid (beverage) that is drawn through the straw 1. This may serve to obtain a sustained release effect or to release different active ingredients sequentially. For example granules containing different flavourings may be provided with delayed release surface coatings of different thickness, whereby the released flavouring varies in time during the consumption of the beverage.

The granules may also have a layered structure formed e.g. by hard panning technology, wherein a plurality of coating solution layers are applied on an edible core (such as sugar seed) in a rotating pan and each layer is dried in order to harden before the application of the subsequent layer. The one or more active ingredients can be added to the coating solution. This technology has significance if concentric layers are to be formed with different active ingredients in which case the composition of the coating solution is changed between the coating steps.

The dimensions (in particular cross section) of the filler 3 and the cross section of the parallel passages 17 are chosen such as to prevent the filler 3 from passing through the parallel passages 17 of the first and second branched portions 2*a*, 2*b* whereby the liquid can be drawn through the straw 1 while the filler 3 is retained in the middle portion 1*c*. According to a preferred embodiment the filler 3 comprises spherical or near spherical granules in which case the skilled person will easily determine the minimal diameter of the granules that can be retained by the parallel passages 17 having a given size and shape. Otherwise the average cross section of the filler 3 can be taken into account. It is also possible to dimension the parallel passages 17 so as to retain a filler 3 of a given size and shape. Increasing the number of the recesses 22 and thereby the number of the passages 17 formed there between results in more narrow cross section of the passages 17. Furthermore, using thicker spacers 13 increases the cross section of the passages 17 as will be explained later on.

Figure 2:
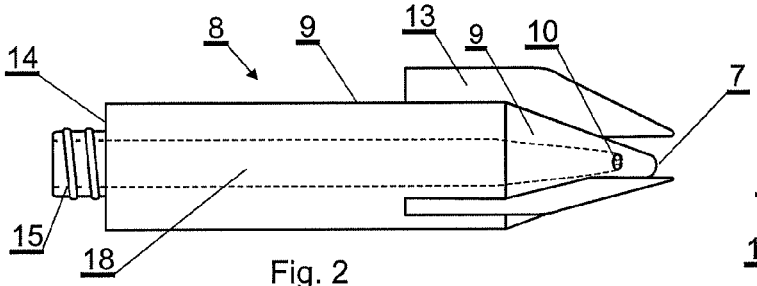
FIG. 2 is aside view of a preferred embodiment of a nozzle according to the invention.
Figure 3:
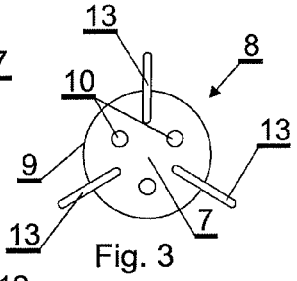
FIG. 3 is a front view of the nozzle according to FIG. 2.
Figure 4:
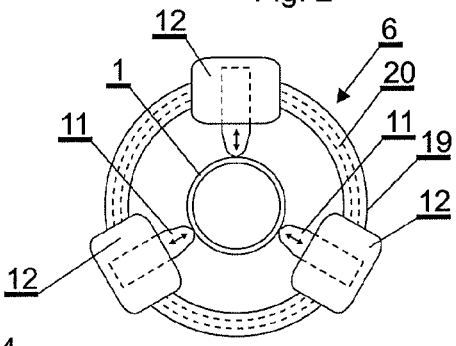
FIG. 4 is a front view of a pressing tool according to the invention, which is illustrated in the open position surrounding the straw prior to deformation.
Figure 5:
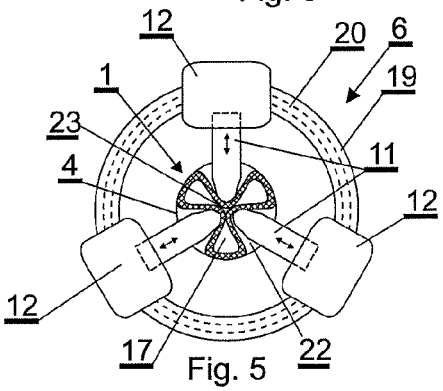
FIG. 5 is a front view of the pressing tool according to FIG. 4 illustrated in the closed position surrounding the straw and showing the cross section of a branched portion created by deformation of the straw.

The drinking straw 1 according to the invention can be formed by a device 5 (best shown in FIG. 6) comprising a nozzle 8 (FIGS. 2 and 3) and a pressing tool 6 (FIGS. 4 and 5). The nozzle 8 comprises a head 9 that is provided with openings 10 near the nozzle end 7 preferably along a circular perimeter and evenly spaced apart from each other. The openings may have a diameter of about 0.3 to 1 mm. Spacers 13 are also provided on the nozzle head 9 which serve to ensure the formation of passages 17 in order to allow liquid communication through the branched portions 2*a*, 2*b*. The shape and thickness of the spacers 13 determine the cross section of the passages 17 as will be apparent to the skilled person. Accordingly, at least two but preferably three to five spacers 13 are provided to form a corresponding number of parallel passages 17. Furthermore, preferably the number of the openings 10 also corresponds to the number of the parallel passages 17 to be formed, and the spacers 13 are preferably evenly spaced between the openings 10 as illustrated in FIGS. 2 and 3. According to the present embodiment the nozzle 8 comprises a nozzle inlet 14 which is provided with a connector portion 15 that is connected with the openings 10 via an internal channel 18. The connector portion 15 allows for connecting the nozzle 8 to a hot air supply providing preferably hot air of about 150 to 250° C. and of about 300 to 700 kPa (3 to 7 bar) pressure, which is conducted to the openings 10 through the channel 18. Other hot fluids than air may be used as well to form the branched portion 2 as will be apparent to the skilled person.

According to the present embodiment the pressing tool 6 comprises chucks 12 and pressing rods 11 inserted therein (see FIGS. 4 and 5). The number of the chucks 12 and pressing rods 11 correspond to the number of the parallel passages 17 to be formed. The pressing rods 11 are displaceable in the direction of the arrows indicated in FIGS. 4 and 5. Displacement of the pressing rods 11 might be achieved by means of hydraulic or pneumatic action or by any other known means. For example the chucks 12 might be supported by a connector 19 having an inner duct 20 for conducting the actuating medium of the pressing rods 11 to the chucks 12. For example the pressing rods 11 may be held in an initial position by means of springs (not shown).

The method of producing the drinking straw 1 according to the invention and in particular of forming the branched portions 2*a*, 2*b* of the drinking straw 1 will be explained with reference to the device 5.

Figure 7:
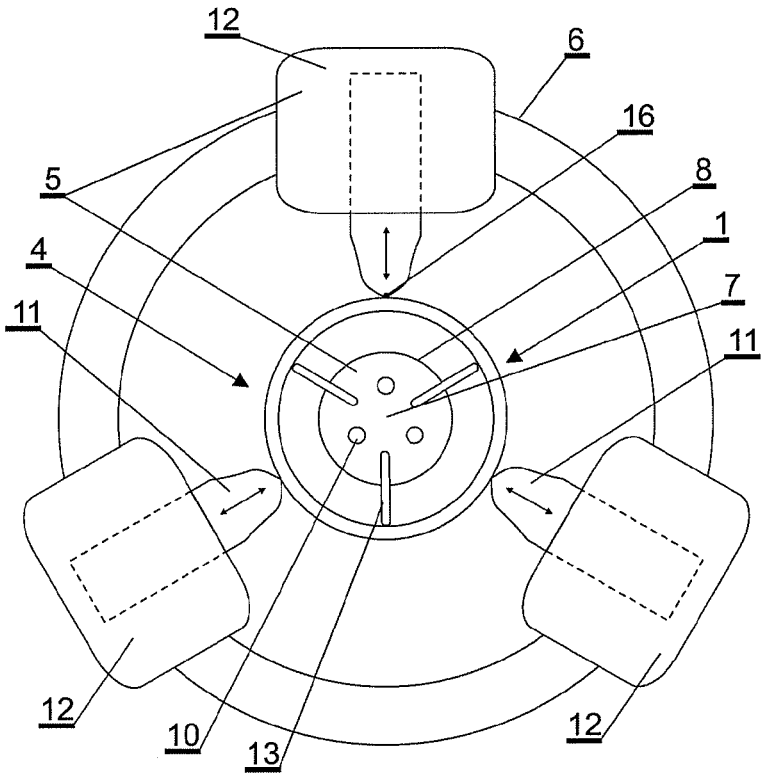
FIG. 7 is a front view of the device showing the nozzle inserted within the straw and the pressing tool arranged around the not yet filled straw.

When using the device 5 the nozzle 8 is inserted into the drinking straw 1 such that the spacers 13 reach at least partly into the portion of the drinking straw 1 where the branched portion 2*a*, 2*b* is to be formed. The wall 21 of the drinking straw 1, where the branched portion 2*a*, 2*b* is to be formed, is fitted between the pressing rods 11 of the pressing tool 6 such that the pressing ends 16 of the pressing rods 11 are each facing a longitudinal axis defined by one opening 10 of the nozzle 8 between two neighbouring spacers 13 as illustrated in FIG. 7. The pressing ends 16 of the pressing rods 11 are somewhat shifted with respect to the openings 10 and the nozzle end 7 in order to allow the pressed regions of the wall 21 of the straw 1 to contact each other or a filling element 3*a* placed within the straw 1 when the pressing rods 11 are pushed inside.

Figure 6:
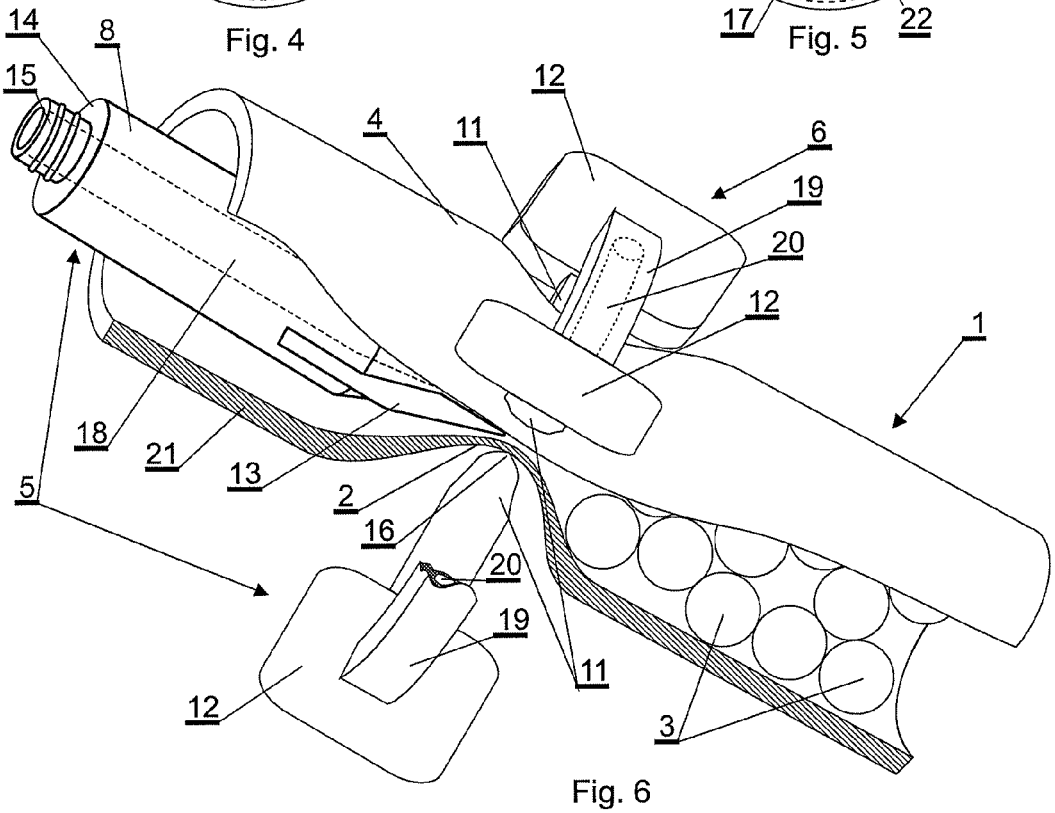
FIG. 6 is a partial cutaway perspective view of a device comprising the nozzle according to FIG. 2 and the pressing tool according to FIG. 4, illustrating the deformation of a second portion of the straw once a first deformed portion has been created in accordance with FIG. 5 and the straw has been filled with a filler.
Figure 8:
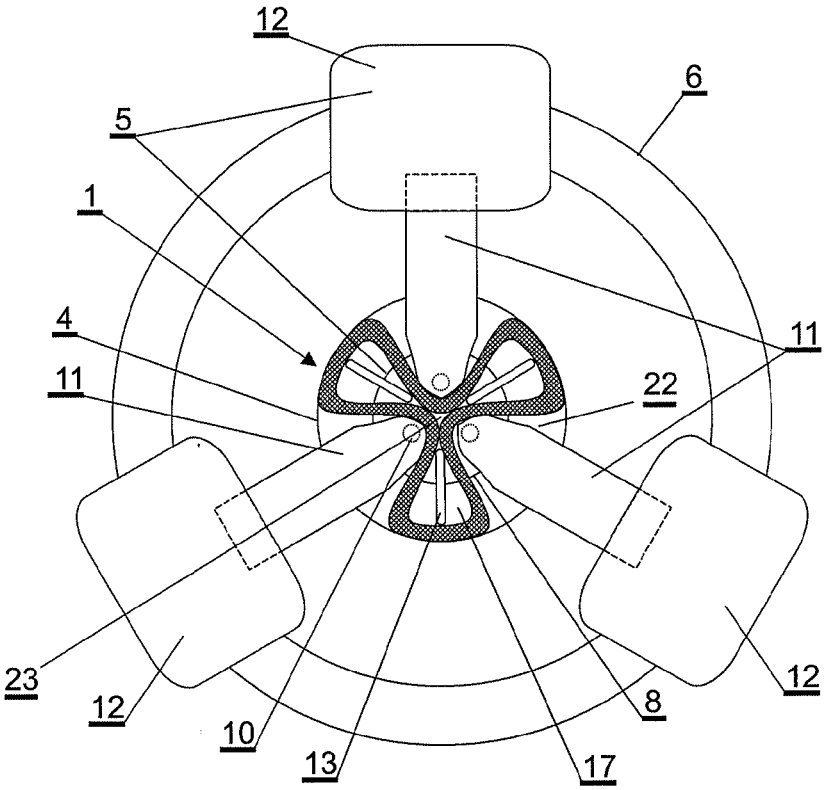
FIG. 8 is a front view of the device showing the nozzle inserted within the straw and the pressing tool arranged around the not yet filled but already pressed straw.

Formation of the branched portions 2*a*, 2*b* is illustrated in FIGS. 6 to 8.

Firstly, prior to filling the straw 1 with the filler 3, the first branched portion 2*a* is formed spaced apart from the first end 4*a* of the straw 1 via the device 5. The straw 1 is inserted into the pressing tool 6 such that the middle part of the branched portion 2*a*, 2*b* to be formed lies between the pressing rods 11 of the pressing tool 6. Following this, the nozzle 8 (FIG. 2) is inserted into the straw 4 such that the nozzle end 7 does not reach the working section of the pressing rods 11 in order to allow the pressing rods 11 to push the wall 21 of the straw inside. The wall 21 of the straw 1 is preferably made from a thermoplastic material, preferably from polypropylene that can be easily deformed when applying heat thereto. The first branched portion 2*a* is formed by applying heat to the inside of the wall 21 by directing high pressure hot air of about 150-250° C., preferably of about 250° C. and of about 500 kPa pressure at the wall 21 through the openings 10 of the nozzle 8 for a very short period of time preferably about 0.2 to 0.6 sec, most preferably about 0.5 sec. The temperature and pressure of the hot air is chosen with regard to the thickness and material properties of the wall 21. If the wall 21 is thick then higher temperatures and greater pressure may be used. Generally the hot air is applied for no longer than 1 sec and the pressure is not increased over 700 kPa.

By supplying hot air to the channel 18 of the nozzle 8 at high pressure and directing the hot air at the inner side of the wall 21 of the straw 1 through the openings 10, the regions of the wall 21 facing the pressing rods 11 is heated and plasticized (or melted) for about 0.2 to 0.6 sec, most preferably about 0.5 sec. After this, the heated regions of the wall 21 are pressed against each other via the pressing rods 11 for a time period of about 0.5 to 1.5 sec, preferably for about 1 sec. For example, the pressing rods 11 may be actuated by means of hydraulic or pneumatic force and may be kept in the initial position by spring force. Heating the inner side of the wall 21 of the straw 1 ensures that the wall 21 can be deformed without causing cracks or other damages. By pressing the pressing rods 11 inside recesses 22 are formed in the wall 21 and where the inner points of the recesses 22 meet the plasticized (melted) material bonds thereby creating an inner seam 23. In practice the method can be regarded as spot welding.

The spacers 13 have for function to support the wall 21 of the straw 1 between the pressed locations whereby parallel passages 17 are created between the recesses 22. The shape and size of the parallel passages 17 can be influenced by the shape and dimension of the spacers 13. The spacers 13 preferably reach beyond the nozzle end 7. In order not to require an excessive thinning of the wall 21 at the branched portions 2*a*, 2*b*, the spacers 13 are preferably tapered whereby the regions between the pressed locations are also drawn inside and the cross sectional diameter of the branched portions 2*a*, 2*b* becomes smaller than the diameter of the tubular end portions 1*a*, 1*b* and the middle portion 1*c*.

Once the first branched portion 2*a* has been created the middle portion 1*c* of the straw 1 is filled with the filler 3 through the second open end 4*b* of the straw 1. The branched portion 2*a* stops the filler 3, which is preferably in the form of granules, from falling out through the first open end 4*a*. After having filled the middle portion 1*c* the second branched portion 2*b* is created in a similar way (see FIG. 6).

Figure 10:
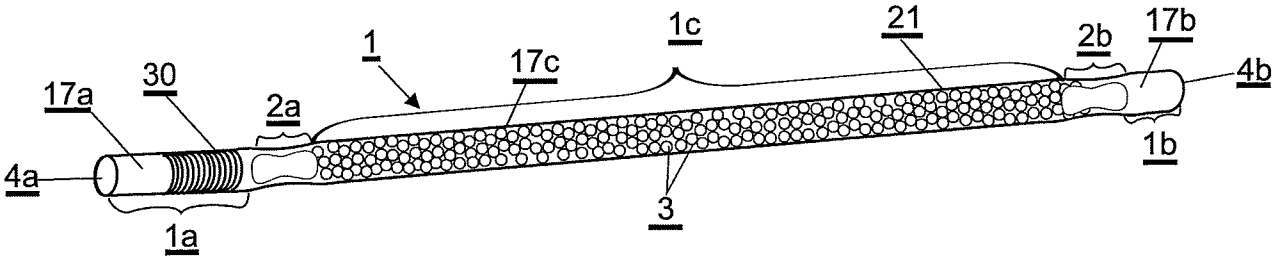
FIG. 10 is a schematic perspective view of a third embodiment of a drinking straw according to the invention comprising an angle-adjustable bellows segment.

The branched portions 2*a*, 2*b* are preferably spaced apart from the first and second ends 4*a*, 4*b* of the straw 1 respectively and their locations are chosen so as to leave sufficiently long tubular end portions 1*a*, 1*b* that can serve as a mouthpiece when the user uses the drinking straw 1. The first and second tubular end portions 1*a*, 1*b* may be symmetric and the user may use either one as the mouthpiece. According to another preferred embodiment depicted in FIG. 10 one of the tubular end portions 1*a* comprises an angle-adjustable bellows segment 30 which is well known in the art and is conventionally used in so-called bendable straws. In the latter case this tubular end portion 1*a* serves as the mouthpiece.

When using the drinking straw 1 the user inserts one end 4*b* into a preferably neutral beverage such as milk, takes the opposite end portion 1*a* (or a portion thereof) into his or her mouth, and applies sucking force so as to draw the liquid (beverage) through the straw 1. The liquid enters the middle portion 1*c* through the parallel passages 17 of the lower (second) branched portion 2*b*, which retain the filler 3. The liquid then passes through the elongate middle portion 1*c* containing the filler 3, where depending on the amount of time spent there, a certain amount of active ingredients such as flavouring agents, colorants, food additives, vitamins, etc. are dissolved into the liquid as well as the solid material of the filler 3, which is preferably sugar. The liquid carrying the dissolved active agents and solid material passes through the parallel passages 17 of the upper (first) branched portion 2*a* while the filler 3 is prevented from entering the upper (first) tubular end portion 1*a*. The user thus draws flavoured or otherwise modified beverage from the upper end 4*a* of the drinking straw 1.

Figure 9:
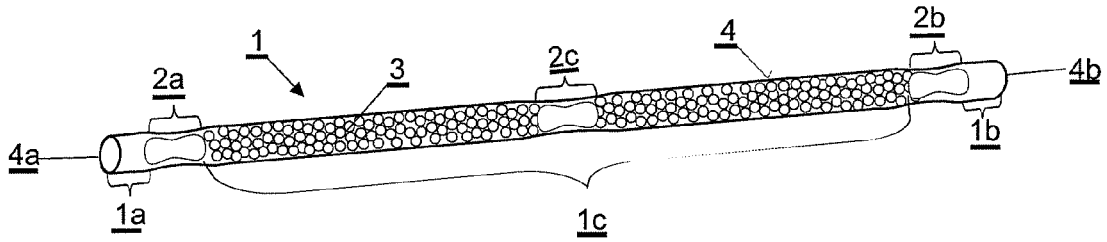
FIG. 9 is a schematic perspective view of a second embodiment of a drinking straw according to the invention comprising an inner branched portion.

According to another preferred embodiment illustrated in FIG. 9 the elongate middle portion 1*c* of the straw 1 is provided with an inner branched portion 2*c*. The inner branched portion 2*c* is depicted as being at the middle of the middle portion 1*c*, however, one or more similar inner branched portions 2*c* may be formed at any location within the middle portion 1*c*. The inner branched portion 2*c* is formed in a similar manner as explained in connection with the first and second branched portions 2*a*, 2*b*. As regards the whole manufacturing process, the inner branched portion is formed after the first branched portion 2*a* has been created and the portion of the middle portion 1*c* between the first branched portion 2*a* and the inner branched portion 2*c* has been filled with the filler 3 (preferably granules). If a plurality of inner branched portions 2*c* is to be provided along the middle portion 1*c*, these are formed one after the other and the corresponding portion of the middle portion 1*c* is filled with the filler 3 prior to the formation of the subsequent inner branched portion 2*c*.

In order to render the drinking straw 1 more appealing the filler 3 arranged between a given pair of branched portions 2*a*, 2*b*, 2*c* (i.e. either an end branched portion 2*a*, 2*b* and an inner branched portion 2*c*, or between two branched portions 2*c*) may differ in colour, shape, size or active ingredient content from the filler 3 arranged between another pair of branched portions 2*a*, 2*b*, 2*c*.

The invention has been described by way of embodiments comprising three parallel passages 17 at each branched portion 2*a*, 2*b*, 2*c*, and accordingly the device 5 has been shown as comprising a nozzle 8 having three nozzle openings 10 and a pressing tool 6 having three chucks 12 and three pressing rods 11 arranged at 120° with respect to each other. However, the branched portions 2*a*, 2*b*, 2*c* may be formed by more or less recesses 22 defining more or less parallel passages 17 in which case a device 5 comprising a corresponding number of nozzle openings 10 and pressing rods 11 can be used for manufacturing purposes.

The drinking straw 1 according to the invention has for advantage that it can be manufactured simply and cost efficiently as it does not require the manufacture and fixing of separate filters. The branched portions 2*a*, 2*b*, 2*c* comprise inner seams 23, which is more user friendly and does not require an additional step of smoothening the outer surface of the wall 21. Furthermore, when creating the inner seams 23 less heat needs to be applied (since only the inner surface of the wall 21 has to be melted and the heat is applied directly to this side of the wall 21) whereby the danger of burning holes in the wall 21 of the straw 1 is eliminated. This results in substantially less waste products (i.e. drinking straws 1 with damaged walls 21 that are unsuitable for use). The seam 23 prevents the wall 21 from reopening.

The process of applying heat from the inside of the straw 1 is further advantageous because this way the thickness of the wall 21 is irrelevant since it is plasticized from the inside whereby deformation is facilitated in that directions (i.e. it is more easy to form the recesses 22 since the inner side of the wall 21 needs to stretch more than the external side) and the deformation can be carried out without occasioning cracks or other damages in the wall 21.

Various modifications to the above disclosed embodiments will be apparent to a person skilled in the art without departing from the scope of protection determined by the attached claims.

The invention claimed is:

1. Drinking straw which is a thermoplastic tube having a longitudinal axis, a first end and a second end, and comprising:

a first tubular end portion adjacent the first end and defining a single passage;

a first branched portion spaced from the first end and defining at least three parallel passages spaced around the longitudinal axis of the drinking straw and being in fluid communication with the single passage of the first tubular end portion;

a second tubular end portion adjacent the second end and defining a single passage;

a second branched portion spaced apart from the second end and defining at least three parallel passages spaced around the longitudinal axis of the drinking straw and being in fluid communication with the single passage of the second tubular end portion;

a hollow elongate middle portion providing fluid communication between the parallel passages of the first branched portion and the parallel passages of the second branched portion; and a filler in the middle portion, said filler containing an active ingredient releasable in liquid drawn through the straw;

the parallel passages of the first and second branched portions being defined by neighboring recesses formed in the tube and a common inner seam connecting the neighboring recesses along the longitudinal axis of the drinking straw; and the filler and the parallel passages being sized to prevent the filler from passing through the parallel passages of the first and second branched portions.

2. The drinking straw according to claim 1, wherein the middle portion is an elongate tubular portion defining a single passage.

3. The drinking straw according to claim 1, wherein one of the tubular end portions comprises an angle-adjustable bellows segment.

4. Drinking straw which is a thermoplastic tube having a first end and a second end comprising:

a first tubular end portion adjacent the first end and defining a single passage;

a first branched portion spaced from the first end and defining at least two parallel passages in fluid communication with the single passage of the first tubular end portion;

a second tubular end portion adjacent the second end and defining a single passage;

a second branched portion spaced apart from the second end and defining at least two parallel passages being in fluid communication with the single passage of the second tubular end portion;

a hollow elongate middle portion providing fluid communication between the parallel passages of the first branched s portion and the parallel passages of the second branched portion; and a filler in the middle portion, said filler containing an active ingredient releasable in liquid drawn through the straw;

the parallel passages of the first and second branched portions being defined by neighboring recesses formed in the tube and an inner seam connecting the neighboring recesses; and the filler and the parallel passages being sized to prevent the filler from passing through the parallel passages of the first and second branched portions; and wherein the middle portion comprises at least one inner branched portion comprising parallel passages that are defined by neighboring recesses formed in the tube and an inner seam connecting the neighboring recesses, and the filler is arranged between the first, second and inner branched portions.

5. The drinking straw according to claim 4, wherein the filler arranged between a given pair of branched portions differ in color, shape or active ingredient content from the filler arranged between another pair of branched portions.

6. The drinking straw according to claim 4, wherein the middle portion is an elongate tubular portion defining a single passage.

7. The drinking straw according to claim 4, wherein one of the tubular end portions comprises an angle-adjustable bellows segment.

* * * * *